US010472838B1

(12) United States Patent
MacGregor

(10) Patent No.: US 10,472,838 B1
(45) Date of Patent: Nov. 12, 2019

(54) FAN FIRST INTEGRATED STADIA BOWL CONSTRUCTION METHOD

(71) Applicant: AECOM, Los Angeles, CA (US)

(72) Inventor: Alastair Niall MacGregor, Aliso Viejo, CA (US)

(73) Assignee: AECOM, Los Angeles, CA (US)

( * ) Notice: Subject to any disclaimer, the term of this patent is extended or adjusted under 35 U.S.C. 154(b) by 0 days.

(21) Appl. No.: 15/975,526

(22) Filed: May 9, 2018

Related U.S. Application Data

(60) Provisional application No. 62/503,531, filed on May 9, 2017.

(51) Int. Cl.
*E04H 3/14* (2006.01)
*F24F 7/04* (2006.01)

(52) U.S. Cl.
CPC ..... *E04H 3/14* (2013.01); *F24F 7/04* (2013.01); *F24F 2221/08* (2013.01)

(58) Field of Classification Search
CPC .... E04H 3/12; E04H 3/14; E04H 3/10; E04B 1/7076; F24F 7/04; F24F 2221/08
See application file for complete search history.

(56) References Cited

U.S. PATENT DOCUMENTS 3,425,173 A * 2/1969 Carlo ..... E04H 3/12 108/99
3,619,958 A * 11/1971 Viesi ..... E04B 7/14 52/6
8,926,441 B2 * 1/2015 Fox ..... H04N 13/363 472/75
9,835,343 B2 * 12/2017 Schafer ..... F24F 5/0021
2011/0277390 A1 * 11/2011 Merrick ..... E04B 1/4107 52/8
2018/0209158 A1 * 7/2018 Ager ..... E04H 3/12

FOREIGN PATENT DOCUMENTS

JP 06200645 A * 7/1994

* cited by examiner

*Primary Examiner* — Paola Agudelo
*Assistant Examiner* — Adam G Barlow
(74) *Attorney, Agent, or Firm* — Knobbe, Martens, Olson & Bear LLP

(57) ABSTRACT

Seating terraces constructed from SPS materials are used to provide integrated HVAC to the seating areas of stadia, arena bowls and similar structures. Portions of the terraces are enclosed from their backsides to provide large ducts or plenums that run beneath the seating terraces where openings into the plenum located between the seats at regular intervals deliver conditioned air to the seating areas. A large header duct runs around the stadium bowl above the top row of seats and delivers air to plenums that run beneath and are integral with the stadium stairways. The seating terrace ducts receive their air supply from the stairway plenums.

22 Claims, 3 Drawing Sheets

FAN FIRST INTEGRATED STADIA BOWL CONSTRUCTION METHOD

CROSS-REFERENCE TO PRIOR APPLICATIONS

The present application is based on and claims both the benefit and priority of U.S. Provisional Patent Application No. 62/503,531 filed on 9 May 2017.

U.S. GOVERNMENT SUPPORT

Not applicable.

BACKGROUND OF THE INVENTION

Area of the Art

The present invention is in the art of building construction and is more specifically directed to an improved construction method for providing HVAC to the seating area of a stadium or arena.

Description of the Background

A continuing problem is the efficient integration of heating and cooling (HVAC) into arena bowls and stadia. Such structures have huge internal volumes and efficiently heating or cooling such tremendous volumes of air can be difficult. In many situations, the structures have transparent or translucent roofs to take advantage of natural lighting. The heat flow through the roof and the natural buoyancy of heated air makes cooling particularly difficult.

The traditional solution has been to build the stadium bowl out of concrete and/or steel raking beams and frames that support the concrete "terraces" which are the riser platforms that support the seating. After the construction is essentially complete, HVAC ductwork is installed. Most commonly, high-level duct work is installed at roof level to force cold air down on the occupied zones. The ducts must necessarily be placed high up so they do not obstruct the view for the highest terraces in the bowl. This necessitates delivering considerable volumes of air at relatively high velocities so that the air stream will reach all of the way to the spectators. Also, because there will be air mixing before the HVAC air reaches the spectators, the air is generally cooled below or heated above the ideal target temperature. There is a considerable energy penalty to deliver such air as well as the comfort problem caused by the sound and feel of rapidly moving air and temperature sensations caused by air that is too hot or too cold.

Commercial spaces such as retail and office space, on the other hand, sometimes employ a displacement ventilation HVAC system. In such a system, air heated or cooled to the target temperature is delivered at low velocities, at low level, directly to the occupied zone where it gently displaces the overly warm or overly cold air at that location. With such a system, the occupants will not hear or feel the HVAC or at most will be aware of a very gentle breeze. Not only are the users more satisfied, low velocity air at or near the target temperature is much more energy efficient to deliver.

Unfortunately, traditional stadia and arenas do not easily accommodate a displacement HVAC system. To deliver effective volumes of conditioned air at low velocities, ducts or plenums of rather large cross-sectional areas are required. While it might be possible to route the relatively small delivery ductwork beneath the seats, the large supply ducts or plenums which feed the smaller ducts have proven to cause difficulties such as impacting the usability of the space below, and the system overall has proven to be significantly more expensive than the traditional overhead system. Furthermore, creating the large openings required by the supply ducts in the structure of the concrete terraces, and coordinating them with the seat fixings, can be challenging, as can the construction of the large suspended soffit structures required to create the plenum, which require significant fixings and follow-on trade coordination with the terraces.

SUMMARY OF THE INVENTION

Composite Sandwich Plate Systems (SPS) plates provide great strength combined with minimum weight and thickness. Seating terraces constructed from SPS materials and/or steel plate are used to provide integrated HVAC to the seating areas of stadia, arena bowls and similar structures. Portions of the terraces are enclosed from their backsides to provide large ducts or plenums that run beneath the seating terraces and are integral with the terrace structures. Openings into the plenum are located, for example, between the seats at regular intervals and deliver a gentle flow of conditioned air to the seating areas.

A large header duct runs around the stadium bowl above the top row of seats. This duct receives conditioned air from the HVAC system and delivers it to plenums that run beneath and are integral with the stadium stairways. The seating terrace ducts receive their air supply from the stairway plenums. Most seating terraces are supplied by a stairway plenum at either end of the seating row. Valves and dampers at the connections between each seating terrace and the stairway plenum as well as similar controls between the header duct and each stairway plenum are used to control the airflow to each seating row and section of the stadium so that airflow to unoccupied areas can be reduced or cut off.

DETAILED DESCRIPTION OF THE INVENTION

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide improved integral HVAC for arena stadia and similar structures.

Recently, there has been somewhat of a revolution in construction of stadia. The traditional seating bowl structure of reinforced concrete has been increasing replaced with Sandwich Plate Systems (SPS) which composite materials are created by sandwiching a core of polyurethane between two steel sheets. Stadia terraces constructed from SPS are typically 80% lighter than concrete structures which permits lighter supporting frames and lighter, smaller foundations. Current SPS plates can span up to 16 meters (52 feet) and can achieve the relevant structural, dynamic and fire rating requirements as for a concrete equivalent. The strength of SPS terraces and simple fixings between each element. The strength of SPS terraces eliminates the need for in-plane horizontal bracing. The steel surfaces of the SPS panels interface easily with the supporting frames and can act compositely with them. The SPS terraces can be prefabricated allowing for much faster and safer stadium construction. These days many stadia seem to have remarkably short lives not to mention the temporary venues that are erected for some international competitions. With SPS terraces the terraces can be demounted at the end of stadium life and be reused for other projects. For example, the wing-like seating stands used in the Aquatics Centre at the London 2012 Olympics contained SPS terraces that were sold and used in a new venue after the end of the Olympic Games.

The present inventor has combined SPS terraces with displacement HVAC systems to provide an "off-the-shelf" construction solution. The present invention creates a single assembly that provides air distribution to the bowl of an arena or stadium as an integrated part of the terrace structure. As will be explained below, this approach can provide additional zone control to vary volume and temperature of air delivered to each section of the bowl thereby reducing over cooling/over-heating and associated energy costs while increasing local comfort for spectators.

Figure 1:
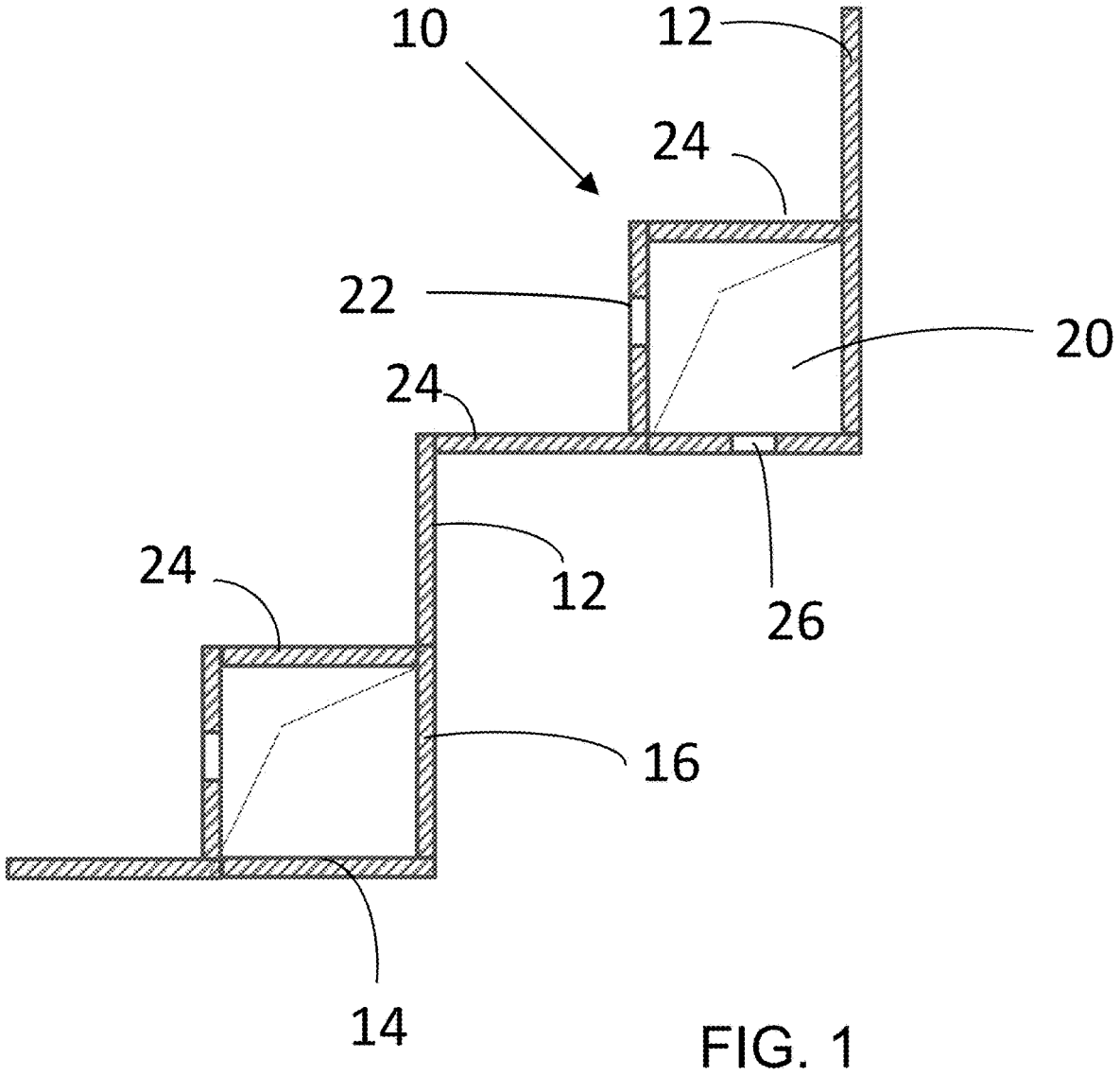
FIG. 1 is a diagrammatic representation of the seating terraces of an arena or stadium employing the invention.

FIG. 1 shows a diagrammatic section through a typical SPS seating zone employing the current invention. The usual seating terraces 10 that form the bowl are shown. The seats will be attached to the top surface 24 of each terrace 10. In this drawing, every other terrace riser 12 has additional horizontal 14 and vertical material 16 that together with the riser actually forms an enclosed soffit-like sealed airpath or "rib" space 20 that acts as an HVAC duct. It's likely that different areas in an arena will have different spacing of the "ribs" 20. SPS has reasonably good insulating abilities as a standard product (due to the polyurethane core) and a sandwich material having even better insulating properties can also be used as necessary.

The SPS and/or steel plate used to create the "ribs" 20 can also be treated with insulation paint to improve thermal properties and/or with an antimicrobial treatment to resist contamination. Diffusers 22, fully integrated into the structure, are installed into openings at regular intervals along the risers 12 and or top seating surfaces 24 (generally between the seats) to allow the controlled escape of heated or cooled air. Diffusers 22 can be equipped with automatic actuators and or dampers and bypasses to control which seating areas are warmed or cooled. In the case of cooled air, the air will gently flow downward and heated air will move upward so that the seated patrons will be bathed in conditioned air. Depending on HVAC needs the interval between the terraces acting as airpaths or ducts can be varied from every riser to every second, third, fourth, etc. riser. In addition, the interval can vary in different areas of the stadium. The undersides of the airpaths 20 can incorporate access hatches and drain connection 26.

Figure 2:
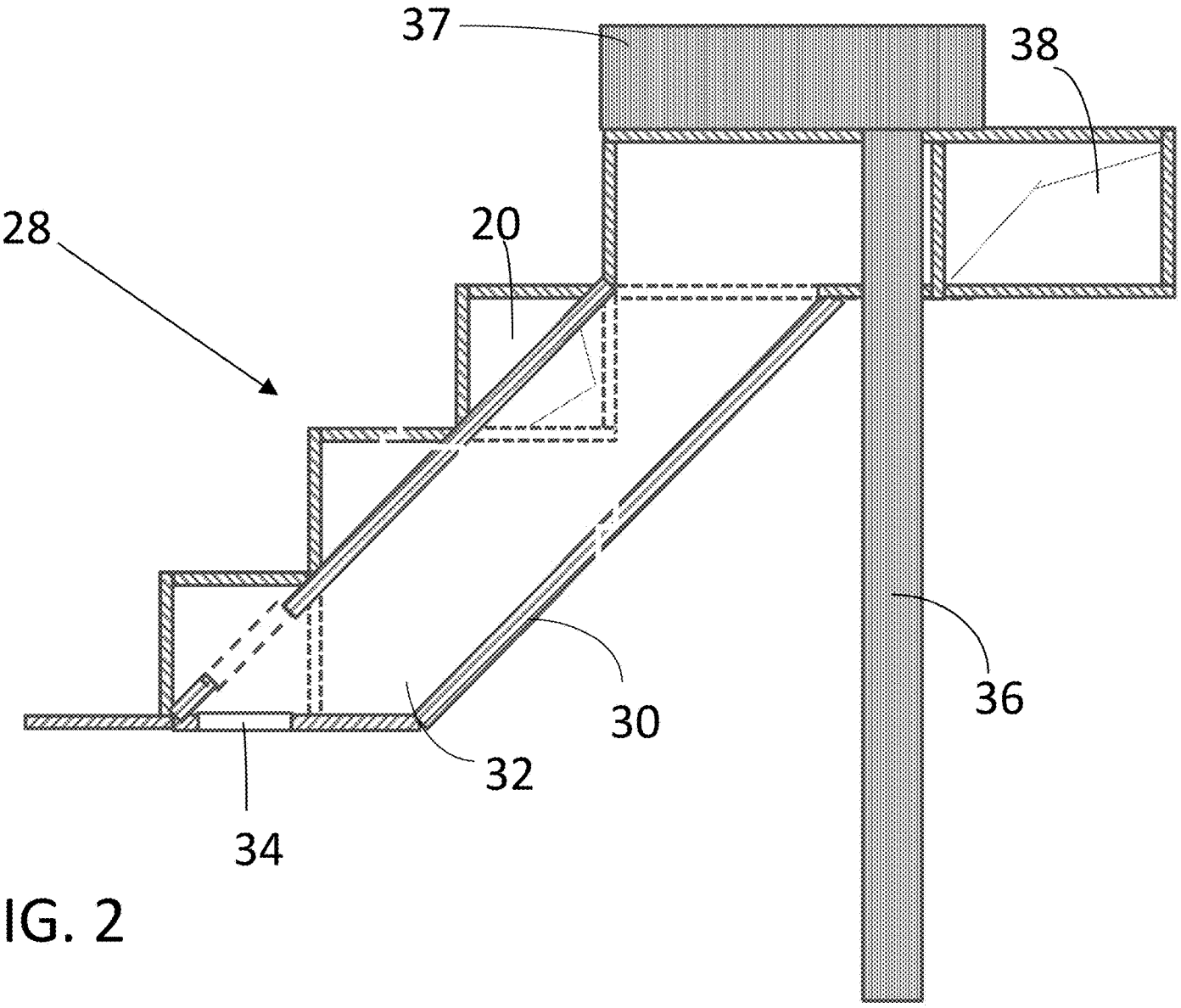
FIG. 2 is a diagrammatic representation of the stair regions of an arena or stadium employing the invention.

FIG. 2 shows a diagrammatic section through the stair zones of the stadium. The stairway 28 is supported by structural column 36 and the ring beam 37. "Raker" beams 30 are distributed around the arena bowl to provide the necessary structural stability to the bowl. These beams 30 also support metal or composite sheeting to form a hollow section to allow for the necessary airpath to be integrated and create a low velocity plenum ("the spine" 32) to which each "rib" 20 connects. Connections to the "ribs" beneath the bowl may be made from either the top or side of the spine 32. Air balancing plates or other controls can be installed at these connections. The section of the raker beam may vary in dimension along its length based upon structural and HVAC air delivery needs. Each of the seating terraces that forms a rib duct 20 joins into and receives conditioned air from the spine 32. At the bottom of the stairs a capped opening 34 can be used to provide conditioned air for temporary, retractable seating units that are constructed along the general line of the seating terraces forming moveable units that can be wheeled onto a portion of the playing field for special occasions (conventions, etc.). A spine plenum 32 runs beneath each stairway and connects to a header duct 38 that is routed at the top of the arena seating bowl with a branch connection at each spine 32. Various dampers and other flow controls can be included at each connection and at intervals within the header duct 38 to control air to seating areas or to entire stair zones.

Figure 3:
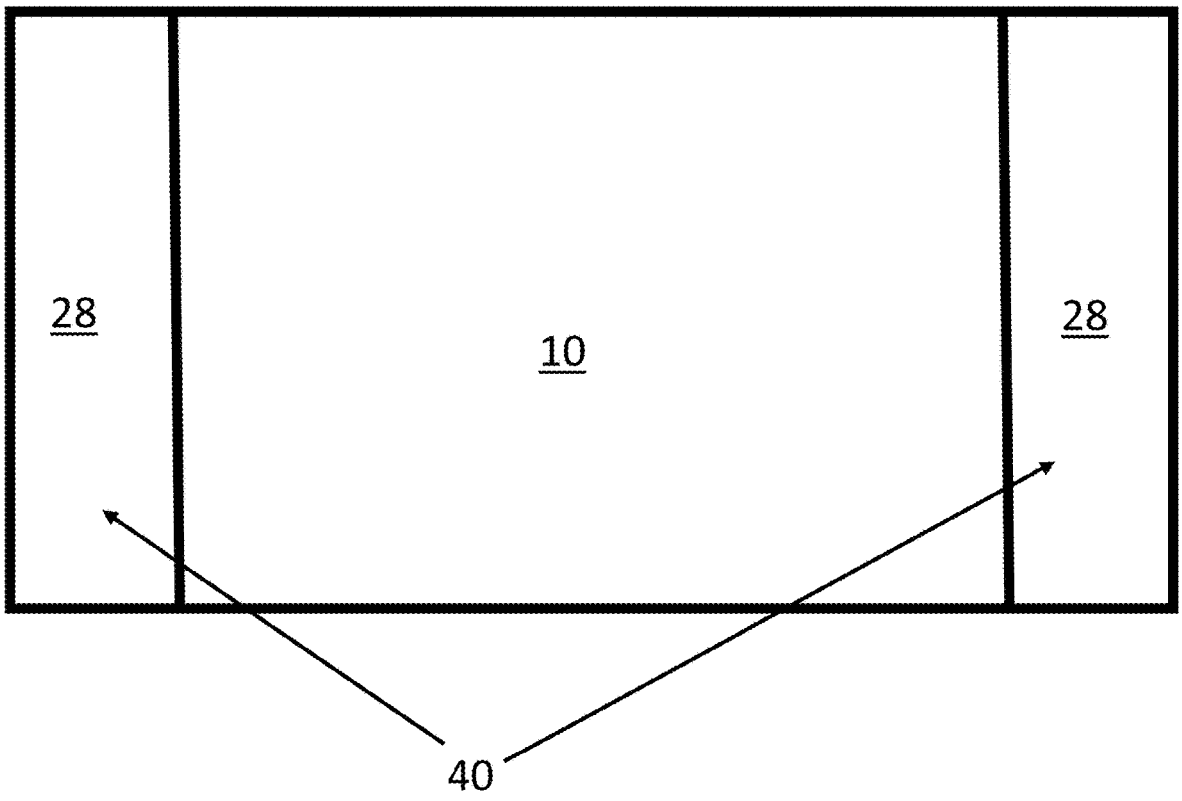
FIG. 3 is a diagrammatic representation of seating terraces and stair regions of an area or stadium.

The way in which air delivery is accomplished creates a lattice of redundant air paths because most seating terraces 10 will be supplied from two different stair zones 40 (one at the left end and one at the right end of each terrace 10, as shown in FIG. 3), thereby significantly reduces the likelihood of a single point of failure. The installation of additional material to form integral air paths such as seating ducts and stair "spine" plenums acts as stiffeners that can enhance the structural performance and create a highly efficient and robust solution of 'box' beams.

Because the ducts and plenums form part of the structure, they are hidden and improve the final aesthetics of the building. Because the ducts are integral, the physical conflicts between installation of the structure and installation of HVAC are reduced while construction of the overall building is expedited. Most components can be prefabricated so that labor and material costs are reduced. Building site safety is enhanced by reducing the number of trades involved. Very little separate construction and installation of ductwork is involved.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purpose of example and that should not be taken as limiting the invention. Therefore, it is to be understood that, within the scope of the appended claims, the invention may be practiced other than as specifically described herein.

What is claimed is:

1. An improved system for arena bowls which provides both the bowl-seating structure and delivery of conditioned air to occupied zones comprising:

terraced seating surfaces wherein at least one of said terraced seating surfaces is closed along its rear surfaces to form integral ducts;

stair zones closed on their lower surfaces to form integral plenums which are in fluidic communication with the integral ducts;

a header duct routed near a top of the arena bowl with fluidic communications to the integral plenums and to a source of conditioned air; and diffusers spaced apart along surfaces of the terraced seating surfaces to emit conditioned air into the occupied zones of the arena bowl.

2. The improved system according to claim 1, wherein every or every second terrace is closed along its rear surfaces to form integral ducts.

3. The improved system according to claim 1, wherein every third, fourth or fifth terrace is closed along its rear surfaces to form integral ducts.

4. The improved system according to claim 1 further comprising dampers or other air control devices to provide zone control of conditioned air.

5. The improved system according to claim 4, wherein the dampers or other air control devices are disposed between the integral ducts and the integral plenums.

6. The improved system according to claim 4, wherein the dampers or other air control devices are associated with the diffusers.

7. The improved system according to claim 1, wherein the diffusers are disposed on outward facing surfaces of the terraced seating surfaces.

8. The improved system according to claim 1 further comprising capped openings to provide conditioned air to temporary seating units.

9. An improved system for arena bowls which provides both the bowl-seating structure and delivery of conditioned air to occupied zones comprising:

terraced seating surfaces wherein at least one of the terraces is closed at its rear surfaces to form integral ducts;

stair zones closed on their lower surfaces to form integral plenums which are in fluidic communication with the integral ducts and with a source of conditioned air; and diffusers spaced apart along surfaces of the terraced seating surfaces to emit conditioned air into the occupied zones of the arena bowl.

10. The improved system according to claim 9, wherein the source of conditioned air comprises a header duct routed near a top of the arena bowl.

11. The improved system according to claim 9, wherein every or every second terrace is closed along its rear surfaces to form integral ducts.

12. The improved system according to claim 9, wherein every third, fourth or fifth terrace is closed along its rear surfaces to form integral ducts.

13. The improved system according to claim 9 further comprising dampers or other air control devices to provide zone control of conditioned air.

14. The improved system according to claim 13, wherein the dampers or other air control devices are disposed between the integral ducts and the integral plenums.

15. The improved system according to claim 13, wherein the dampers or other air control devices are associated with the diffusers.

16. The improved system according to claim 9, wherein the diffusers are disposed on outward facing surfaces of the terraced seating surfaces.

17. The improved system according to claim 9 further comprising capped openings to provide conditioned air to temporary seating units.

18. The improved system according to claim 1, wherein the terraced seating surfaces are constructed from a composite material and/or steel.

19. The improved system according to claim 18, wherein the terraced seating surfaces are constructed from the composite material, the composite material comprising Sandwich Plate System (SPS) composite sheets.

20. The improved system according to claim 19, wherein the stair zones are constructed of SPS.

21. The improved system according to claim 9 wherein the terraced seating surfaces are constructed from Sandwich Plate System (SPS) composite sheets.

22. The improved system according to claim 21, wherein the stair zones are constructed of SPS.

* * * * *